US006024072A

United States Patent [19]

Hamada

[11] Patent Number: 6,024,072

[45] Date of Patent: Feb. 15, 2000

[54] FUEL PUMP CONTROL APPARATUS

[75] Inventor: Mikio Hamada, Handa, Japan

[73] Assignee: Aisan Kogyo Kabushiki Kaisha, Japan

[21] Appl. No.: 09/081,606

[22] Filed: May 20, 1998

[30] Foreign Application Priority Data

May 21, 1997 [JP] Japan ..... 9-131401
Jun. 5, 1997 [JP] Japan ..... 9-148077

[51] Int. Cl.[7] ..... F02M 32/04

[52] U.S. Cl. ..... 123/497; 123/456

[58] Field of Search ..... 123/497, 456, 123/514, 357

[56] References Cited

U.S. PATENT DOCUMENTS

| | | | |
|---|---|---|---|
| 4,248,194 | 2/1981 | Drutchas | 123/497 |
| 4,359,984 | 11/1982 | Nakao | 123/497 |
| 4,756,291 | 7/1988 | Commins | 123/497 |
| 4,800,859 | 1/1989 | Sagasaki | 123/497 |
| 5,379,741 | 1/1995 | Matysiewicz | 123/497 |
| 5,483,940 | 1/1996 | Namba | 123/497 |
| 5,579,738 | 12/1996 | Frischmuth | 123/497 |
| 5,699,772 | 12/1997 | Yonekawa | 123/497 |
| 5,715,797 | 2/1998 | Minagawa | 123/497 |
| 5,740,783 | 4/1998 | Learman | 123/497 |

FOREIGN PATENT DOCUMENTS

| | | |
|---|---|---|
| 3-63764 | 6/1991 | Japan . |
| 7-166993 | 6/1995 | Japan . |
| 8-232790 | 9/1996 | Japan . |

*Primary Examiner*—Carl S. Miller
*Attorney, Agent, or Firm*—Finnegan, Henderson, Farabow, Garrett & Dunner, L.L.P.

[57] ABSTRACT

In a fuel pump control apparatus provided by the present invention, if a target fuel pressure is changed, processing is carried out to determine whether the target fuel pressure has been increased or decreased so that proper transient state control can be executed. If the target fuel pressure has been increased, a fuel pump is driven by a maximum driving signal till the pressure of fuel reaches 90% of a new higher target fuel pressure. If the target fuel pressure has been decreased, on the other hand, the fuel pump is driven by a minimum driving signal till the pressure of fuel reaches 110% of a new lower target fuel pressure. In either case, transition state control is executed thereafter to drive the fuel pump at a duty ratio determined on the basis of an injection flow rate and the target fuel pressure till a predetermined delay time lapses. After the transition state control is finished, a steady state control is restored. In the steady state control, the duty ratio is determined on the basis of the pressure of the supplied fuel and the target fuel pressure. As a result, the fuel pump control apparatus provided by the present invention is capable of well keeping up with a change in supplied fuel pressure required by the internal combustion engine while allowing the cost and the size thereof to be reduced.

14 Claims, 9 Drawing Sheets

FUEL PUMP CONTROL APPARATUS

This application is based on applications Nos. 9-131401 and 9-148077 filed in Japan, the contents of which is hereby incorporated by reference.

BACKGROUND OF THE INVENTION

1. Field of the Invention

The present invention relates to a fuel pump control apparatus for controlling an operation to drive a fuel pump for supplying fuel to a fuel injection nozzle of an engine. To put it in detail, the present invention relates to a fuel pump control apparatus that is capable of changing the pressure of fuel supplied to a fuel injection nozzle of an engine with a good response characteristic with respect to a requested fuel pressure in each operating state of the engine and, hence, capable of supplying fuel to a fuel injection nozzle at an amount and a pressure appropriate for the operating state.

2. Description of the Prior Art

In general, the conventional control of a fuel pump for supplying fuel to a fuel injection nozzle of an engine is implemented as a so-called PWM control or a so-called duty ratio control for turning on and off a current input to the pump due to the fact that the PWM or duty ratio control is easy to execute and allows the amount of consumed electric power to be reduced. In addition, in order to obtain information on the operating state of the engine, a variety of sensors are installed at some locations on the engine. Control of an operation carried out by the fuel pump control apparatus to drive the fuel pump is based on signals output by the sensors to supply fuel to a fuel injection nozzle at a fuel pressure required by the engine. When the fuel pressure required by the engine changes due to a variation in engine operating state or a variation in environment temperature, the fuel pump control apparatus makes an adjustment in accordance with such a change to just produce a new fuel pressure required by the engine.

In relation to what is described above, a variety of technologies for changing the pressure of fuel supplied to a fuel injection nozzle have been disclosed. Examples of such technologies are disclosed in Japanese Patent Laid-open No. Hei 8-232790 and Japanese Patent Laid-open No. Hei 7-166993. The following is a brief description of technologies of this type. To begin with, the configuration of the fuel supplying apparatus is shown in FIG. 7 in a simple and plain manner. As shown in the figure, a fuel pump 30 is attached to a fuel tank 32. The fuel pump 30 is linked to fuel injection nozzles 6 installed on an intake pipe 4 by a fuel supplying pipe 34. Fuel in the fuel tank 32 is sucked by the fuel pump 30 and transmitted to the fuel injection nozzles 6 by way of the fuel supplying pipe 34 and a fuel rail 34*a* by applying a pressure to the fuel.

In addition, a return path 38 is provided between the fuel pump 30 and the fuel rail 34*a*. Excess fuel is returned to the fuel tank 32 by way of the return path 38. Furthermore, a pressure regulator 36 and a valve 35 are provided on the return path 38. A throttle 33 is installed in parallel to the valve 35. The pressure regulator 36 and the valve 35 are used for adjusting and changing the pressure of fuel supplied to the fuel injection nozzles 6. A fuel pressure sensor 3 for measuring the pressure of the supplied fuel is provided at a proper location in the fuel supply system. The fuel pressure sensor 3 supplies information on the fuel pressure to an engine control unit (ECU) 20.

The fuel pressure in the fuel supply system is controlled by the engine control unit 20 by using a control algorithm based on signals C supplied by a variety of sensors installed at some locations on the engine. The ECU 20 outputs control signals used in the control. Examples of the control signals are a control signal C1 output to the fuel injection nozzles 6 for injection of fuel by opening and closing the fuel injection nozzles 6, a control signal C2 for opening and closing the valve 35 and a control signal C3 for controlling the operation to drive the fuel pump 30. FIG. 8 is a diagram showing a typical waveform of the control signal C1. During a period Ta of the control signal C1, fuel is injected to the engine. It should be noted that the period Ta, that is, the injection timing, is determined almost entirely by the rotational speed of the engine.

On the other hand, FIG. 9 is a diagram showing a typical waveform of the control signal c3. The average voltage of the control signal C3 is (Tb/To) X VB where Tb is the pulse width, To is a period of typically 50 msec or shorter and VB is the voltage of a power supply which has a fixed value of about 12 V. The output of the fuel pump 30 is all but proportional to the average voltage. Thus, since To and VB are constant, the average voltage, that is, the output of the fuel pump 30, can be adjusted by changing Tb. As a result, by setting Tb at a proper value, excessive fuel can be prevented from being supplied to the fuel injection nozzles 6. That is, fuel of an amount appropriate for the operating state of the engine 2 can be supplied to the fuel injection nozzles 6. For example, when the flow rate of fuel returned through the return path 38 is high, the length of the period Tb of the pump control signal C3 is reduced to decrease the flow rate.

The pressure of the supplied fuel is adjusted by opening and closing the valve 35. To put it in detail, when the valve 35 is opened, an attempt is made to change the pressure Pf of the supplied fuel toward a value equal to a pressure Pr adjusted by the pressure regulator 36. When the valve 35 is closed, on the other hand, an attempt is made to change the pressure Pf of the supplied fuel toward a value higher than the pressure Pr adjusted by the pressure regulator 36.

As disclosed in Japanese Utility Model Laid-open No. Hei 3-63764, there is also known a technology whereby a plurality of pressure regulators having different adjusted pressures are arranged in the fuel supply system and the pressure of supplied fuel is adjusted by properly selecting some of the pressure regulators.

However, the technologies for changing and adjusting the pressure of supplied fuel described above have the following problems. In the first place, in the technology disclosed in Japanese Patent Laid-open No. Hei 8-232790, the pressure of fuel supplied to the fuel injection nozzles 6 is changed by opening and closing the valve 35. That is, first of all, the valve 35 is opened or closed in order to change the fuel pressure. Then, the operation to drive the fuel pump 30 is controlled. As a result, it takes time to get the fuel pressure actually changed, giving rise to a problem of responsiveness. In particular, in order to set the fuel pressure at a high value, the valve 35 is closed and then the fuel pump 30 is controlled at a fixed fuel discharging power. Thus, it takes time to get the fuel pressure actually increased after the request for a change in fuel pressure is received. As described above, the control to change the fuel pressure disclosed in Japanese Patent Laid-open No. Hei 8-232790 has responsiveness and stability problems.

As for the technology disclosed in Japanese Utility model Laid-open No. Hei 3-63764, a plurality of pressure regulators are used, raising not only a cost problem but also a problem of difficulty to accommodate the fuel supply system with such an enlarged size in a limited engine room or a limited fuel tank. There is also raised a problem that a big additional restriction is imposed on the pipe design of the fuel supply system. In addition, in order to increase the fuel pressure to a high value, there is also needed a fuel pump that is capable of discharging fuel at a pressure higher than a set pressure of a pressure regulator set for a high pressure. A fuel pump with a large pumping capacity or a large fuel discharging power gives rise to a problem that the size of the fuel pump is enlarged and the amount of electric power consumed thereby is also increased as well. These problems are explained by referring to FIG. 10. FIG. 10 is a diagram showing graphs representing characteristics of the fuel pump. The graphs show relations between a voltage applied to the fuel pump and the discharged flow rate with the fuel pressure taken as a parameter. The graph indicated by notation $Pf=Pr_1$ is a line representing a relation for a fixed fuel pressure set by the pressure regulator on the low pressure side. On the other hand, the graph indicated by notation $Pf=Pr_2$ is a line representing a relation for a fixed fuel pressure set by the pressure regulator on the high pressure side. The graphs indicate that, in order to increase the fuel pressure Pf, it is necessary to increase the voltage applied to the fuel pump and, in order to increase the discharged flow rate at a fixed fuel pressure, it is also necessary to increase the voltage applied to the fuel pump as well.

Pay attention to a case in which the fuel pressure is increased to a high value $Pr_2$. In this case, there is a difference between the fuel flow rate Q demanded by the engine and the fuel flow rate q demanded by a system disclosed in Japanese Utility Model Laid-open No. Hei 3-63764. This is because the fuel flow rate q includes an excess fuel flow rate set by a pressure regulator on a low pressure side and an excess fuel flow rate set by a pressure regulator on a high pressure side. As such, since it is necessary to supply fuel of an amount larger than the fuel flow rate Q demanded by the engine, a fuel pump with a large pumping capacity or a large fuel discharging power is required, giving rise to a problem that the size of the fuel pump is enlarged and the amount of electric power consumed thereby is also increased as well.

The operation to drive the fuel pump 30 is controlled by reducing the flow rate of returned fuel to adjust the amount of fuel supplied to the fuel injection nozzles 6, but the amount of the returned fuel can not be made zero. That is, fuel of at least a fixed amount has to be returned to the fuel tank 32. Once transmitted to the high-temperature engine 2, the returned fuel has a temperature higher than that of the fuel in the fuel tank 32, raising a problem that the fuel in the fuel tank 32 evaporates easily because its temperature increases. Thus, the problem described earlier is not solved completely. There is also proposed another solution called an in-tank return structure wherein the pressure regulator 36 is installed in the fuel tank 32 so that returned fuel passes through only the fuel tank. However, this solution causes problems such as one that the amount of agitated fuel in the fuel tank 32 and the driving amount of the fuel pump 30 can not each be reduced to a minimum.

SUMMARY OF THE INVENTION

It is an object of the present invention which addresses the problems described above to provide a fuel pump control apparatus for controlling the operation to drive a fuel pump so that the pressure of fuel output by the fuel pump well keep up with changes in fuel pressure demanded by an engine wherein the cost and the size of the fuel pump control apparatus can be reduced by elimination of a fuel return path and pressure regulators.

In order to solve the problems described above, the present invention provides a fuel pump control apparatus for controlling a fuel pump supplying fuel to a fuel injection nozzle of an engine, the fuel pump control apparatus comprising: a target fuel pressure computing means for computing a target fuel pressure on the basis of an operating state of the engine; a change detecting means for detecting whether or not the target fuel pressure has changed; a steady state control means which is used for determining a control quantity of the fuel pump on the basis of a pressure of the fuel supplied to the fuel injection nozzle and the target fuel pressure when the target fuel pressure is found unchanged; and a transient state control means which is used for determining the control quantity of the fuel pump by adopting a method different from that of the steady state control means when the target fuel pressure is found changed.

In the fuel pump control apparatus, first of all, signals representing the operating state of the engine are received. Then, the target fuel pressure computing means computes a target fuel pressure of fuel supplied to fuel injection nozzles on the basis of an operating state of the engine. The target fuel pressure is normally computed by a means such as a routine program or a map. It is desirable to set a certain target fuel pressure for each range of changes in engine operating state. In such a case, if a change in engine operating state is within a predetermined range, the target fuel pressure stays at a value set for the range. The change detecting means is used for detecting whether or not the target fuel pressure of the current cycle has changed from that of the previous cycle. That is, the change detecting means determines whether the operation of the engine is in a steady or transient state. A change in engine operating state within a predetermined range indicates that the operation of the engine is in a steady state. On the other hand, a change in engine operating state beyond the predetermined range indicates that the operation of the engine is in a transient state.

Processing carried out to set a signal for driving the fuel pump varies in dependence on whether the operation of the engine is in a steady or transient state. The processing to set a signal for driving the fuel pump can be carried out by a means such as a map, a table or a routine program. In addition, it is desirable to set the signal for driving the fuel pump in terms of a duty ratio or a value of a voltage applied to the fuel pump.

If the outcome of the determination indicates that the operation of the engine is in a steady state, the steady state control means computes a control quantity of the fuel pump on the basis of the pressure of fuel supplied to the fuel injection nozzles and the target fuel pressure, controlling an operation to drive the fuel pump in the so-called steady state control. If the outcome of the determination indicates that the operation of the engine is in a transient state, on the other hand, the transient state control means computes the control quantity of the fuel pump by adopting a method different from that of the steady state control means in order to let the pressure of the fuel keep up with the change in target fuel pressure in a short period of time, controlling an operation to drive the fuel pump in the so-called transient state control.

As described above, in the fuel pump control apparatus provided by the present invention, the signal for driving the fuel pump is found by adopting a method which varies in dependence on whether the operation of the engine is in a steady or transient state. That is, in a transient state such as a start or an acceleration wherein it is necessary to change the pressure of the fuel in a short period of time, the signal for driving the fuel pump is found by adopting an appropriate method which is different from that proper for a steady state such as an idle state or a cruise at a constant speed requiring a constant pressure of the fuel. As a result, it is possible to drive the fuel pump by determining the signal for driving the fuel pump which is appropriate for the operating state of the engine. Thus, fuel can be supplied to the fuel injection nozzles without causing excessive variations in fuel pressure, that is, variations having an adverse effect on the control, even if the fuel supply system is designed into a returnless configuration. In particular, when the target fuel pressure is changed, it is possible to let the pressure of the fuel keep up with the change in target fuel pressure in a short period of time to provide a satisfactory response characteristic by execution of transient state control. In addition, since the fuel supply system is designed into a returnless configuration, the cost and the size of the fuel pump control apparatus can be reduced. Furthermore, since no pressure regulator is used for adjusting the pressure of the fuel, a fuel pump with a small capacity will work. As a result, the size and the electric power consumption of the fuel pump can be reduced.

The transient state control means is allowed to determine the control quantity of the fuel pump on the basis of the flow rate of the fuel at the fuel injection nozzles and the target fuel pressure. It is more desirable to set the control quantity at a large value in the case of a high target fuel pressure in comparison with the case of a low target fuel pressure. Further, the control quantity is set at a large value in the case of a high flow rate of fuel at the fuel injection nozzles in comparison with the case of a low flow rate. As a result, it is possible to implement an excellent driving operation of the fuel pump wherein, the higher the amount of required fuel at the fuel injection nozzles, the larger the value of the control quantity set by the driving operation.

The transient state control means is also allowed to set the control quantity of the fuel pump at a maximum or minimum value. For this reason, it is desirable to provide a direction detecting means which is used for determining whether a change in target fuel pressure is an increase or a decrease when the target fuel pressure changes. If a change in target fuel pressure is an increase, the transient state control means sets the control quantity of the fuel pump at the maximum value. If a change in target fuel pressure is a decrease, on the other hand, the transient state control means sets the control quantity of the fuel pump at the minimum value. When the target fuel pressure is increased, putting the operation of the engine in a transient state, the control quantity is set at the maximum value, that is, the duty ratio of the signal for driving the fuel pump is set at 100% or a maximum voltage is applied to the fuel pump. As a result, the fuel pump is driven at a maximum output, causing the pressure of the supplied fuel supplied to increase to the new target fuel pressure in a short period of time. When the target fuel pressure is decreased, putting the operation of the engine in a transient state, on the other hand, the control quantity is set at the minimum value, that is, the duty ratio of the signal for driving the fuel pump is set at 0% or a minimum voltage is applied to the fuel pump. As a result, the pressure of the supplied fuel decreases to the new target fuel pressure in a short period of time accompanying injection of the fuel from the fuel injection nozzles.

It is desirable to execute the transient state control based on the maximum or minimum value till the absolute value of the difference between the pressure of the supplied fuel and the target fuel pressure becomes smaller than a predetermined value and then to execute the steady state control thereafter. This is because, if the transient state control is executed forever, there is fear that the pressure of the supplied fuel exceeds the new target fuel pressure, resulting in an overshoot. Typically, the predetermined value is thus set at ±10% of the target fuel pressure.

It is further desirable to execute transition state control whereby the control quantity of the fuel pump is determined by adopting a method different from those for the steady state control and the transient state control upon completion of the transient state control based on the maximum or minimum value instead of restoring the steady state control right away. This is because, in some cases, there is a very big difference in control quantity between the transient state control based on the maximum or minimum value and the steady state control, making detection of quantities such as the pressure of the supplied fuel inaccurate, hence, putting the control in an unstable state.

A thinkable example of the transition state control is determination of the control quantity of the fuel pump based on the flow rate of the fuel at the fuel injection nozzles and the target fuel pressure. It is desirable to set the control quantity at a large value for a high target fuel pressure in comparison with a low target fuel pressure. Further, it is desirable to set the control quantity at a large value for a high fuel flow rate in comparison with a low fuel flow rate. It is possible to implement an excellent driving operation of the fuel pump wherein, the higher the flow rate of the fuel at the fuel injection nozzles, the larger the value of the control quantity set by the driving operation. In addition, since such a value of the control quantity is determined in the transition state control which is executed between the transient state control based on the maximum or minimum value and the steady state control, the number of inconveniences caused by an abrupt change in control quantity is reduced, allowing stable control to be implemented. For this reason, the transition state control is executed for a period of time it takes to stabilize the control of the fuel pressure.

BRIEF DESCRIPTION OF THE DRAWINGS

Embodiments of the present invention will be described with reference to the following diagrams wherein.

DESCRIPTION OF THE PREFERRED EMBODIMENTS

The present invention will become more apparent from a careful study of the following detailed description of some preferred embodiments each implementing a fuel pump control apparatus in a fuel supply system of an engine with reference to the accompanying diagrams.

First Embodiment

Figure 2:
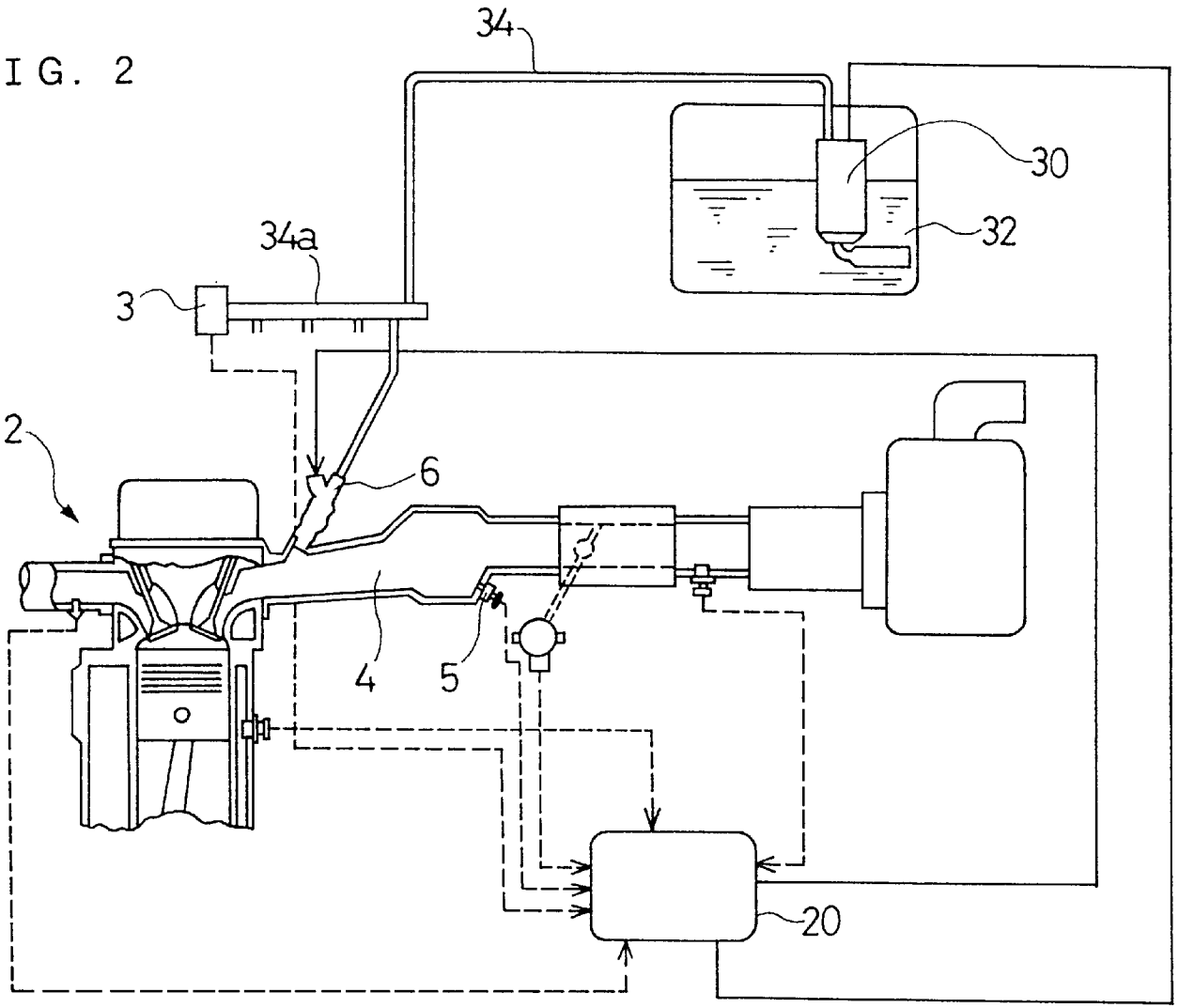
FIG. 2 is a diagram showing the configuration of a fuel supply system of an engine employing the fuel pump control apparatus.
Figure 7:
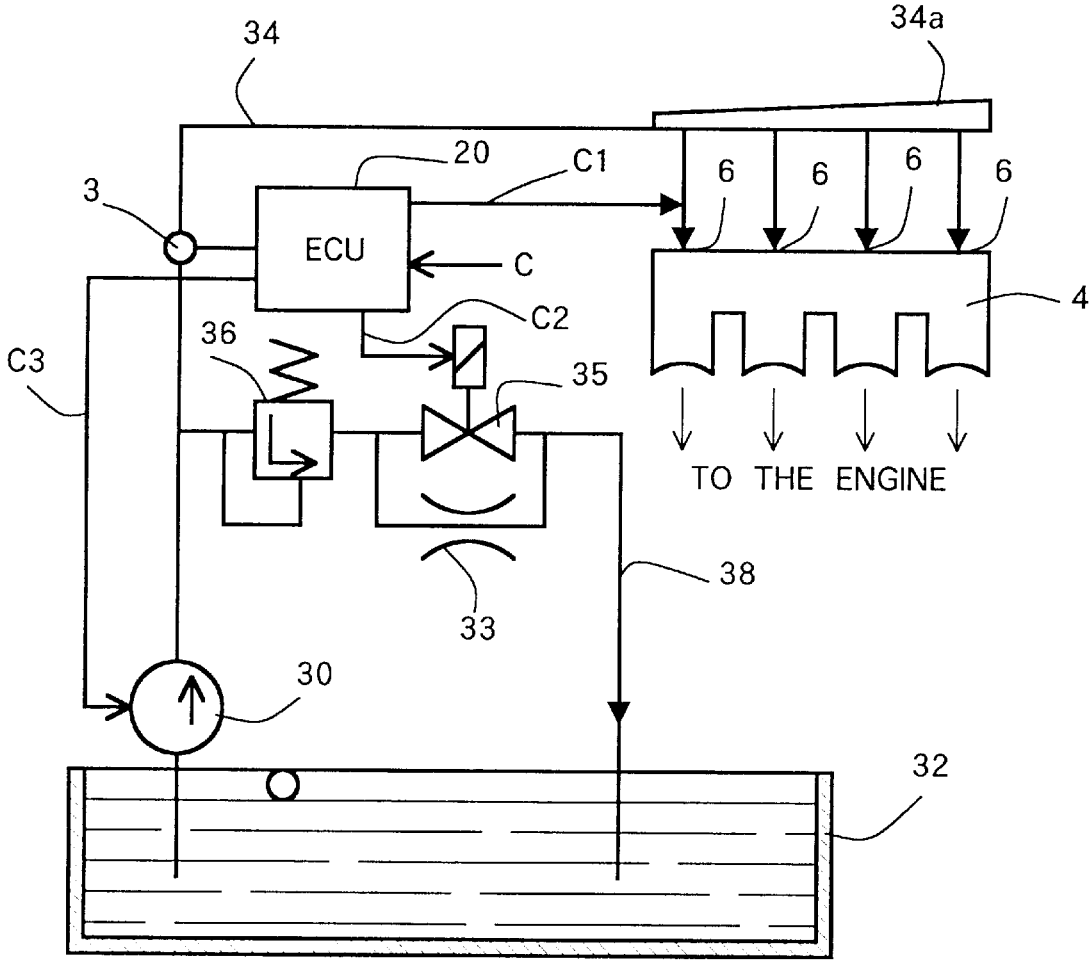
FIG. 7 is a diagram showing the configuration of a typical fuel supply system of an engine to which the conventional fuel pump control apparatus is applied.
Figure 8:
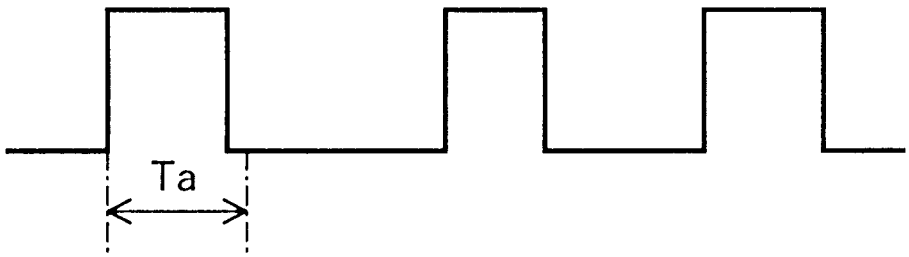
FIG. 8 is a diagram showing the waveform of a control signal supplied to fuel injection nozzles.
Figure 9:
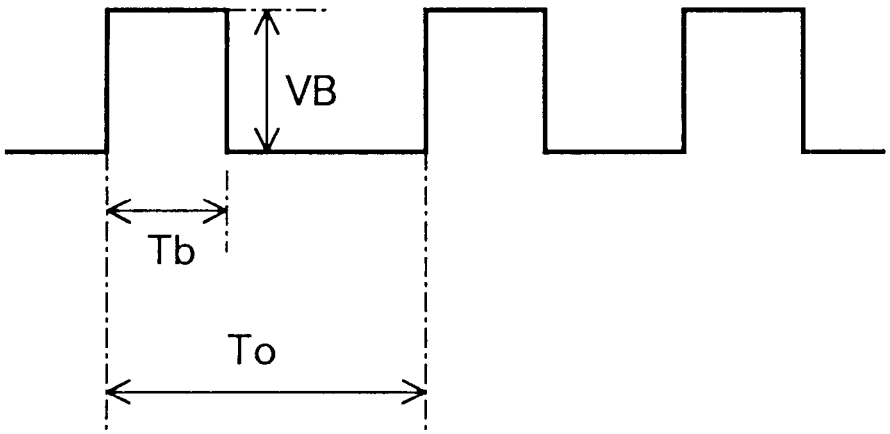
FIG. 9 is a diagram showing the waveform of a control signal supplied to a fuel pump.
Figure 10:
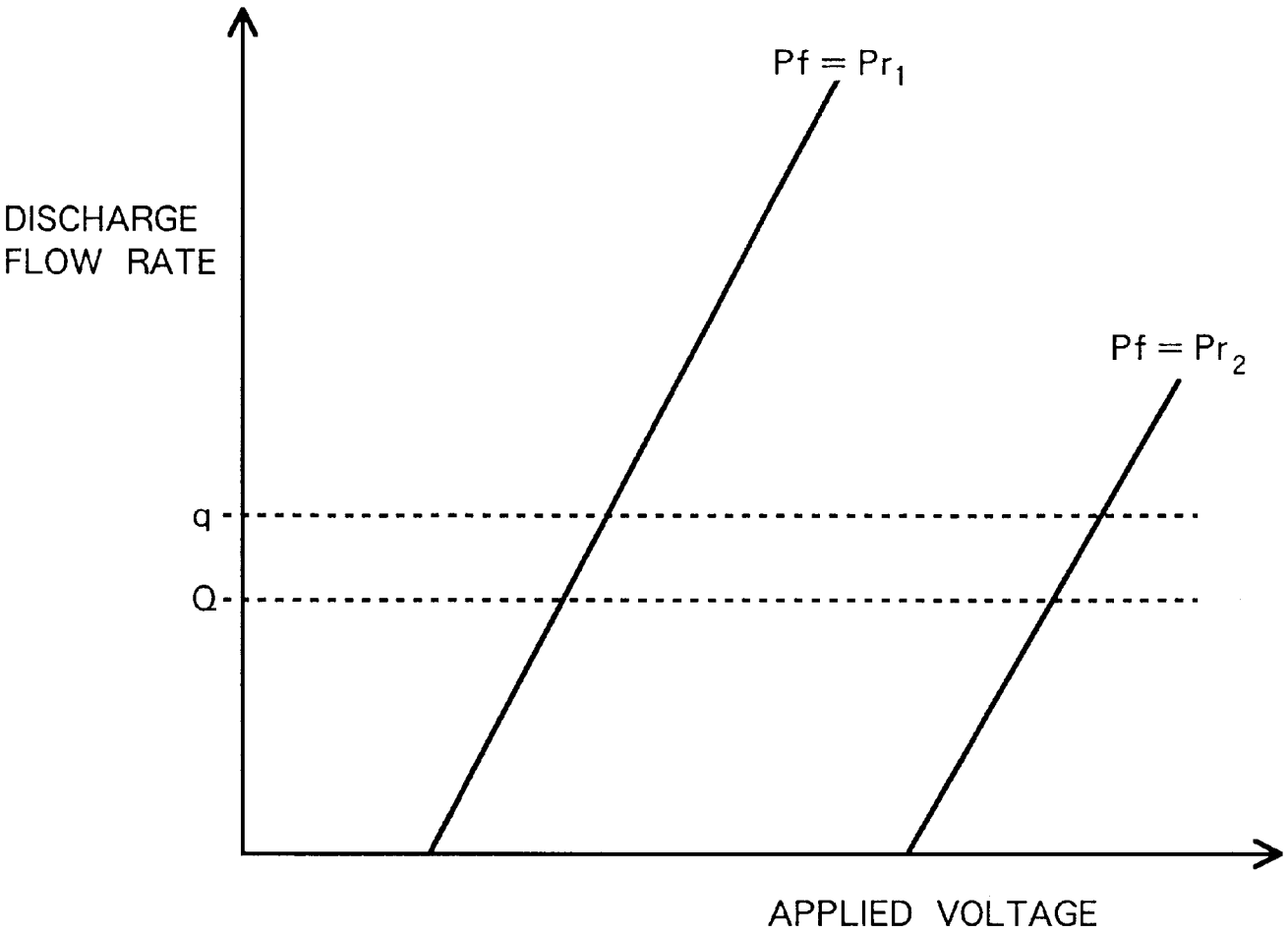
FIG. 10 is a diagram showing graphs representing characteristics of the fuel pump.

The description begins with a configuration of a fuel supply system of the engine 2 shown in FIG. 2 in a simple and plain manner wherein a fuel pump control apparatus provided by the present invention is employed. It should be noted that components of FIG. 2 identical with those employed in the conventional fuel pump control apparatus shown in FIG. 7 are denoted by the same reference numerals as the latter. As shown in the figure, a fuel pump 30 is attached to a fuel tank 32. A fuel injection nozzle 6 is installed on an intake pipe 4. When the fuel injection nozzle 6 is opened, fuel is injected to the engine 2. Furthermore, an intake pressure sensor 5 for measuring a pressure in the intake pipe 4 is installed on the pipe 4 and a fuel pressure sensor 3 for measuring the pressure of fuel supplied to the fuel injection nozzle 6 is installed on a fuel rail 34*a*. The fuel rail 34*a* is used for distributing fuel supplied to the fuel injection nozzle 6 which is installed on each cylinder of the engine 2.

A fuel pipe for supplying fuel from the fuel tank 32 to the fuel injection nozzle 6 comprises a fuel supplying pipe 34 attached to the fuel pump 30 and the fuel rail 34*a*. Fuel in the fuel tank 32 is sucked by the fuel pump 30 and supplied to the fuel supplying pipe 34. Fuel supplied to the fuel supplying pipe 34 is then passed on to the fuel rail 34*a* for distribution to cylinders of the engine 2. A pressure is applied to the fuel in the direction toward the fuel injection nozzle 6 installed on each of the cylinders. The fuel supply system implemented by the present embodiment has a returnless configuration with no pressure regulator 36 and no return path 38. That is, the pressure of the supplied fuel is changed or adjusted only by driving the fuel pump 30. It should be noted that a control method of changing or adjusting this fuel pressure will be described later.

A fuel pump control apparatus for controlling the output of the fuel pump 30 is embedded in the engine control unit (ECU) 20. The engine control unit 20 comprises a commonly known CPU as well as ROM and RAM units. The ROM unit is used for storing in advance, such as programs required in processing carried out by the CPU. For examples, programs for calculating a target fuel pressure and for finding an initial set value are stored in the ROM unit. On the other hand, the RAM unit is used for temporarily storing results of the processing carried out by the CPU to be read out later from time to time. It should be noted that the fuel pump control apparatus can also be built separately from the engine control unit 20.

Signals output by a variety of sensors installed on the engine 2 such as the fuel pressure sensor 3 and the intake pressure sensor 5 are supplied to the engine control unit 20. The signals undergo a variety of processing carried out by the engine control unit 20 in accordance with the operating condition of the engine 2 at a request made by the driver. As a result of the processing, the engine control unit 20 outputs signals such as a valve opening signal to the fuel injection nozzle 6 and a driving signal to the fuel pump 30 in order to control the fuel pressure, that is, the fuel flow rate, in the fuel supply system of the engine 2.

Figure 1:
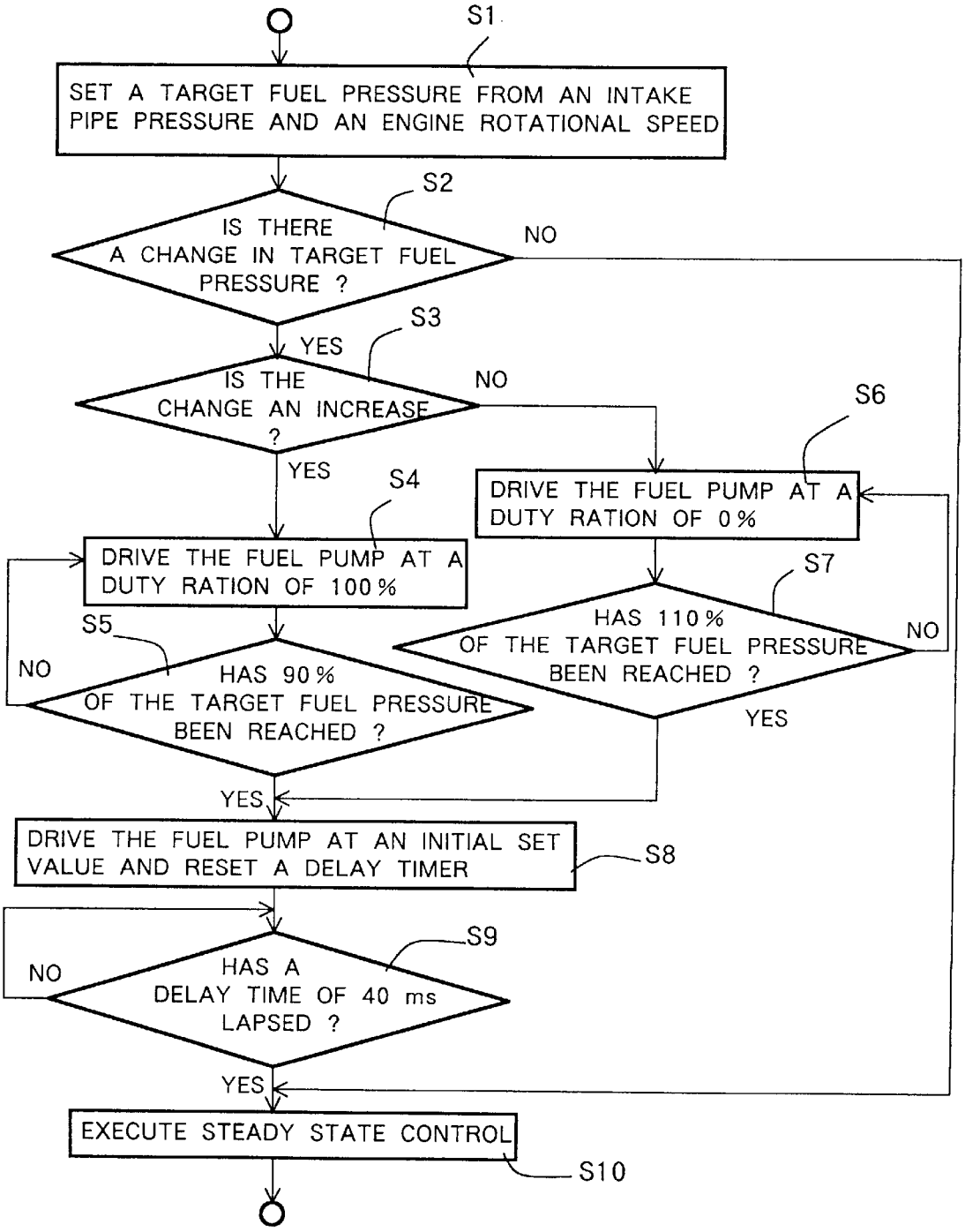
FIG. 1 is a flowchart representing a routine of control processing carried out by an embodiment implementing a fuel pump control apparatus provided by the present invention.

Processing performed by the fuel pump control apparatus employed in the fuel supply system having a configuration described above is explained by referring to FIG. 1 showing a flowchart representing a routine of control processing carried out by an embodiment implementing the fuel pump control apparatus. The processing represented by the flowchart is carried out repeatedly at predetermined intervals each having a length of about several milliseconds.

Step S1

As shown in the figure, the flowchart begins with a step S1 at which a target fuel pressure is calculated from the intake pipe pressure and the rotational speed of the engine. That is, the step S1 corresponds to processing carried out by a target fuel pressure computing means. The intake pipe pressure is detected by the intake pressure sensor 5 while the rotational speed of the engine is detected by measuring the crank angle. The target fuel pressure is typically found from a map stored in the ROM unit of the engine control unit 20.

Figure 3:
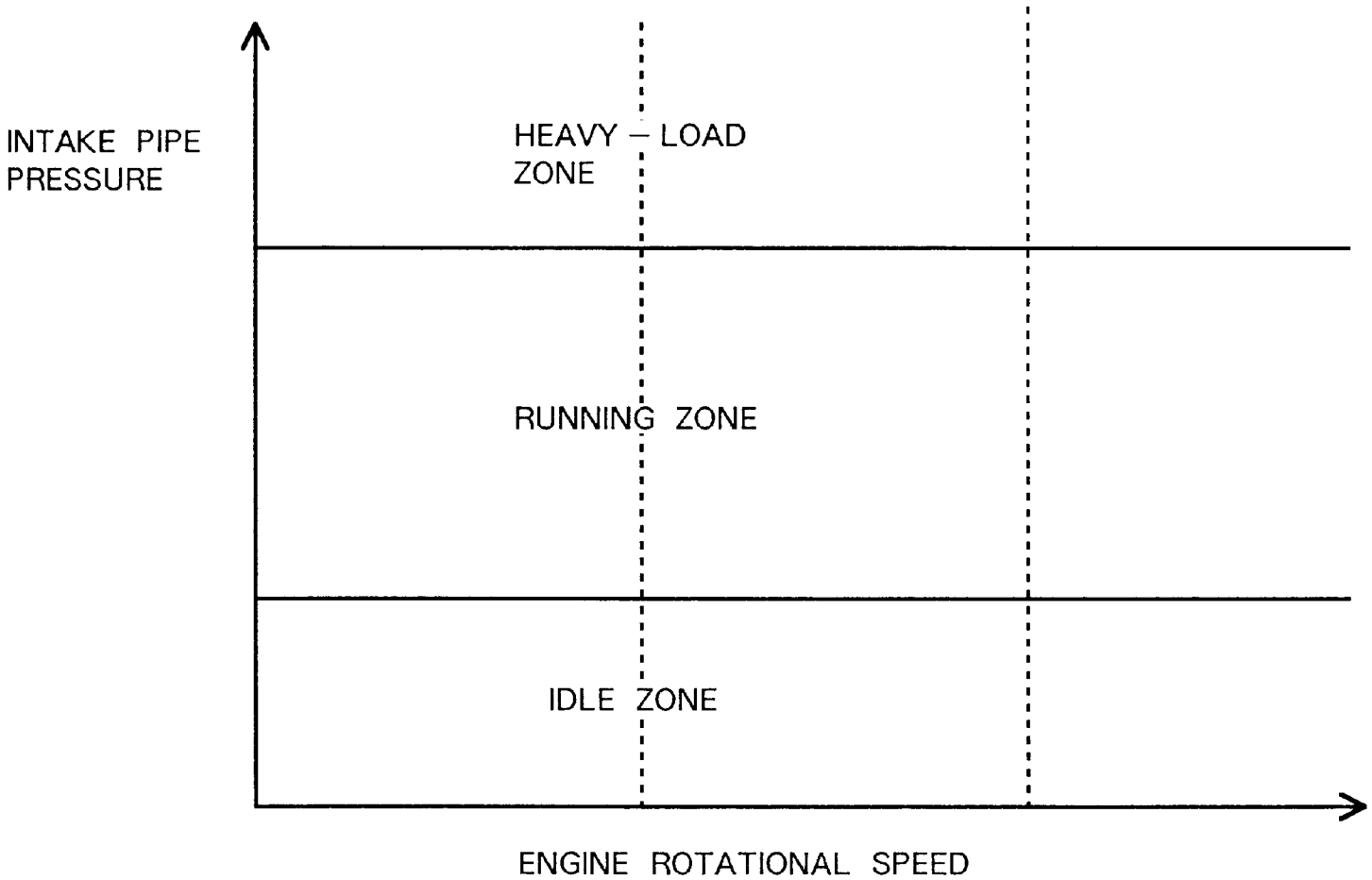
FIG. 3 is a diagram showing graphs representing a map for finding a target fuel pressure from the rotational speed of the engine and the intake pipe pressure.

FIG. 3 is a diagram showing graphs representing the map for finding a target fuel pressure from the rotational speed of the engine and the intake pipe pressure. As shown in the figure, the map comprises 3 operating zones of the engine, namely, an idle zone, a running zone and a heavy-load zone, each representing a range of intake pipe pressures. The map is also divided into 3 ranges of engine rotational speeds to give a total of 9 blocks for each of which a target fuel pressure is set in advance. That is, a change in operating state within a block is regarded as a variation in a steady state which does not necessitate a change in target fuel pressure.

In the map shown in FIG. 3, the idle zone represents a range of intake pipe pressures from 100 to 300 kPa and the running zone represents a range of intake pipe pressures from 300 to 500 kPa. The heavy-load zone represents a range of intake pipe pressures from 500 to 1,000 kPa. For each block in the zones, a predetermined target fuel pressure is set. The target fuel pressure for each block has a value optimum for the engine. The optimum values are found typically from experiments. The number of intake pipe pressure zones and the number of engine rotational speed ranges on the map do not have to be 3 as shown in FIG. 3. Instead, they can each be any arbitrary number of at least 2.

Step S2

The flow of processing then goes on to a step S2 to determine whether or not there is a difference in target fuel pressure between the previous and current cycles, that is, a determination whether or not the operating state of the engine 2 is a steady or transient state. The step S2 corresponds to processing carried out by a change detecting means. If the outcome of the determination indicates that there is a difference in target fuel pressure between the previous and current cycles (S2: Yes), the flow of processing proceeds to a step S3 at which control for a transient state is executed. If the outcome of the determination indicates that there is no difference in target fuel pressure between the previous and current cycles (S2: No), on the other hand, the flow of processing proceeds to a step S10 at which control for a steady state is executed, by-passing pieces of processing of the steps S3 and the subsequent steps up to S9.

Step S3

As described above, for S2: Yes, the flow of processing continues to the step S3 to determine whether the change in target fuel pressure is an increase or a decrease. The step S3 corresponds to processing carried out by a direction detecting means. In the case of an acceleration where the load of the engine becomes heavier, for example, the outcome of the determination indicates an increase in target fuel pressure. In the case of a deceleration where the load of the engine becomes lighter, on the other hand, the outcome of the determination indicates that the change is a decrease in target fuel pressure. If the outcome of the determination indicates an increase in target fuel pressure (S3: Yes), the flow of processing goes on to a step S4. If the outcome of the determination indicates that the change is a decrease in target fuel pressure (S3: No), on the other hand, the flow of processing goes on to a step S6.

Steps S4 and S5

At the step S4, the fuel pump 30 is driven to pump fuel at a maximum fuel discharging power because it is necessary to drive the fuel pump 30 to keep up with the change in target fuel pressure in a short period of time. That is, the fuel pump 30 is driven at a duty ratio of 100%. In this way, the pressure of the supplied fuel can be changed to the new target fuel pressure in a short period of time.

By the way, if the fuel pump 30 is driven at the maximum fuel discharging power till the pressure of the supplied fuel reaches the new target fuel pressure, an overshoot occurs even if a steady state has been attained after the drive. By an overshoot, an actual fuel pressure exceeding the target value is implied. Since such an overshoot generates an excess change in fuel pressure, it takes time to get the excess change converged to a stable state, resulting in a lack of control stability. In order to solve this problem, the flow of processing goes on to a step S5 to determine whether or not the pressure of fuel supplied by the fuel pump 30 driven at the maximum fuel discharging power has reached a value lower than the new target fuel pressure, that is, a value equal to 90% of the target. If the pressure of the supplied fuel has reached 90% of the target fuel pressure, the operation to drive the fuel pump 30 at the maximum fuel discharging power is halted to end the transient state control. The flow of processing then proceeds to a step S8.

Steps S6 and S7

At the step S6, the signal to drive the fuel pump 30 is set at a minimum value as opposed to the step S4 because the target fuel pressure has decreased. That is, the operation to drive the fuel pump 30 is halted. Then, fuel is no longer supplied to the fuel injection nozzle 6. Since the engine 2 keeps consuming fuel, however, the pressure of the fuel starts to drop. The flow of processing then continues to a step S7 to determine whether or not the pressure of fuel supplied by the fuel pump 30 driven at the minimum fuel discharging power has reached a value higher than the new target fuel pressure, that is, a value equal to 110% of the target. If the pressure of the supplied fuel has reached 110% of the target fuel pressure, the halted state of the fuel pump 30 is ended. The flow of processing then proceeds to the step S8. By executing such control, the same effect as the processing carried out at the steps S4 and S5 is obtained. That is, in the present embodiment, the range of the fuel pressure for entering a transition state to be described below is predetermined at 90% to 110% of the target fuel pressure.

Step S8

At the step S8, a duty ratio of the signal driving the fuel pump 30 is found from the actual injected flow rate and the new target fuel pressure. The fuel pump 30 is driven by having the signal stuck to the found duty ratio in so-called transition state control. In other words, the fuel pump 30 is driven by a signal with a duty ratio which will be set in control of the fuel pressure when the actual pressure of fuel becomes equal to the new target fuel pressure in which case steady state control is executed. The reason why the transition state control is executed after transient state control has been ended as such is to enhance the stability of the control of the fuel pressure. That is, since the transient state control is ended before the pressure of the fuel reaches the new target fuel pressure, the pressure of the fuel is still varying upon the completion of the transient state control. In addition, since the duty ratio of the transient state control is 100% or 0%, a big difference from the duty ratio of the steady state control may exist. Thus, if the steady state control is restored abruptly, the control of the fuel pressure will not go well, that is, the duty ratio will not be stabilized. It is thus much to be feared that the state in which the pressure of the fuel is not stable will continue. In order to prevent the control of the fuel pressure from getting into an unstable state, the duty ratio is fixed. As a result, since the fuel pump 30 is driven at a fixed output, the variations in fuel pressure converge to result in a stable state in a short period of time.

The determination of a duty ratio is based on the following map which represents a relation between the injection flow rate and the target fuel pressure.

| | | Injection flow rate [lit / hr] | | | |
|---|---|---|---|---|---|
| | | 5 | 10 | 15 | 20 |
| Target fuel pressure [kPa] | 100 | 40 | 45 | 50 | 55 |
| | 300 | 70 | 74 | 79 | 82 |
| | 500 | 90 | 93 | 97 | 100 |

In the above 2-dimensional map showing values of the duty ratio, the horizontal and vertical axes represent the injection flow rate and the target fuel pressure respectively. According to the map, the higher the injection flow rate and/or the higher the target fuel pressure, the higher the required duty ratio. This is because, at a high injection flow rate and/or at a high target fuel pressure, the amount of required fuel is also large as well. Values of the duty ratio fetched out from the map are used in interpolation processing to determine a duty ratio that is appropriate for a given injection flow rate and a given target fuel pressure. Assume that a target fuel pressure of 300 kPa and an injection flow rate of 7 lit/hr are given. In this case, since a value of the duty ratio corresponding to the given injection flow rate is not included in the map, interpolation is required to give a duty ratio of 71.6 computed from the following equation. In addition, interpolation with respect to both the injection flow rate and the target fuel pressure can also be carried out.

$$(74-70)\cdot\frac{7-5}{10-5}+70=71.6$$

Step S9

The flow of processing then goes on to a step S9 to determine whether or not a steady state control can be restored. In the case of the present embodiment, the determination of the step S9 is formed typically by determining whether or not a predetermined period of time has lapsed since the start of the processing carried out at the step S8 by using a delay timer. To put it concretely, when an operation to drive the fuel pump 30 is started at a duty ratio determined at the step S8, that is, at an initial set value, the delay timer is reset. At the step S9, the delay time is then measured to be compared with a predetermined value. The predetermined value which is found typically from experiments is a time it takes to have variations in fuel pressure settled to a certain degree since the introduction of a change in target fuel pressure. The value thus varies from engine to engine. By the way, the predetermined typical value of the delay time is 40 msec in the case of the present embodiment. Thus, the fuel pump 30 is driven to generate a fixed output at a duty ratio (the initial set value) determined at the step S8 till the delay time reaches 40 msec. As the delay time attains 40 msec, the flow of processing proceeds to a step S10 at which steady state control is executed. As a result, by executing the transition state control at the steps S8 and S9, the fuel pressure can be changed smoothly during a transition of restoring the steady state control from the transient state control. In addition, the steady state control can be restored in a stable state of the fuel pressure. Thus, stable fuel pressure changing control can be implemented.

Step S10

At the step S10, the pressure of the fuel in the fuel rail 34*a* is all but constant due to the fact that the operation of the engine 2 is in a steady state. Thus, since the signal output by the fuel pressure sensor 3 is stable, the difference between the fuel pressure measured by the fuel pressure sensor 3 and the target fuel pressure can be found with a high degree of accuracy. The operation to drive the fuel pump 30 can be controlled so as to correct this difference. Thus, at the step S10, a duty ratio of the signal for driving the fuel pump 30 can be computed from the fuel pressure measured by the fuel pressure sensor 3 and the target fuel pressure found at the step S1 in a steady state control to drive the fuel pump 30.

The processing routine of the steps S1 to S10 described above is repeated at very short cycle times to control the operation to drive the fuel pump 30, allowing a fast response to a fuel pressure requested by the engine 2 to be made and stable control of the pressure of the fuel to be executed.

Figure 4:
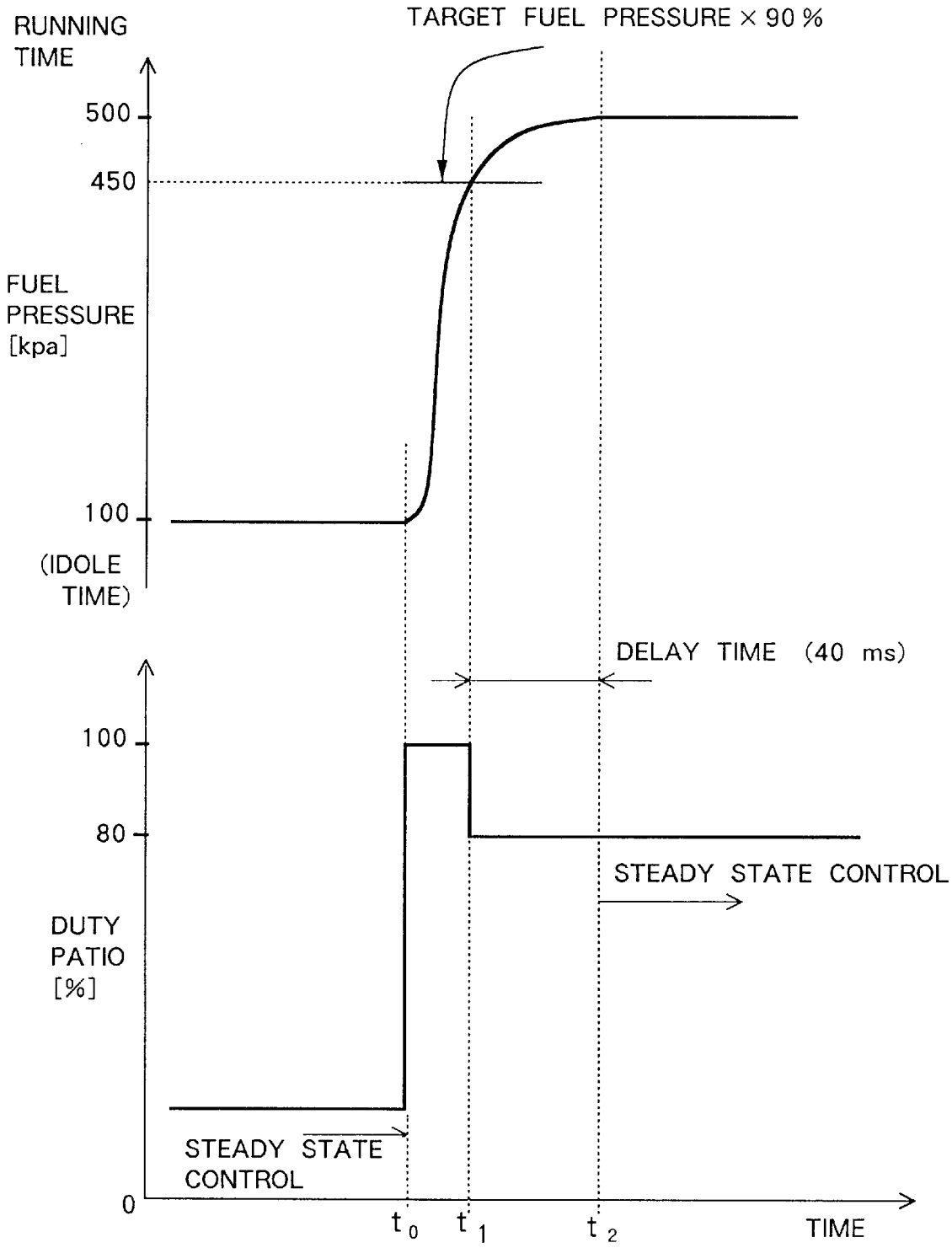
FIG. 4 is an explanatory diagram used for describing changes in set duty ratio and changes in fuel pressure that are made in response to an increase in target fuel pressure.
Figure 5:
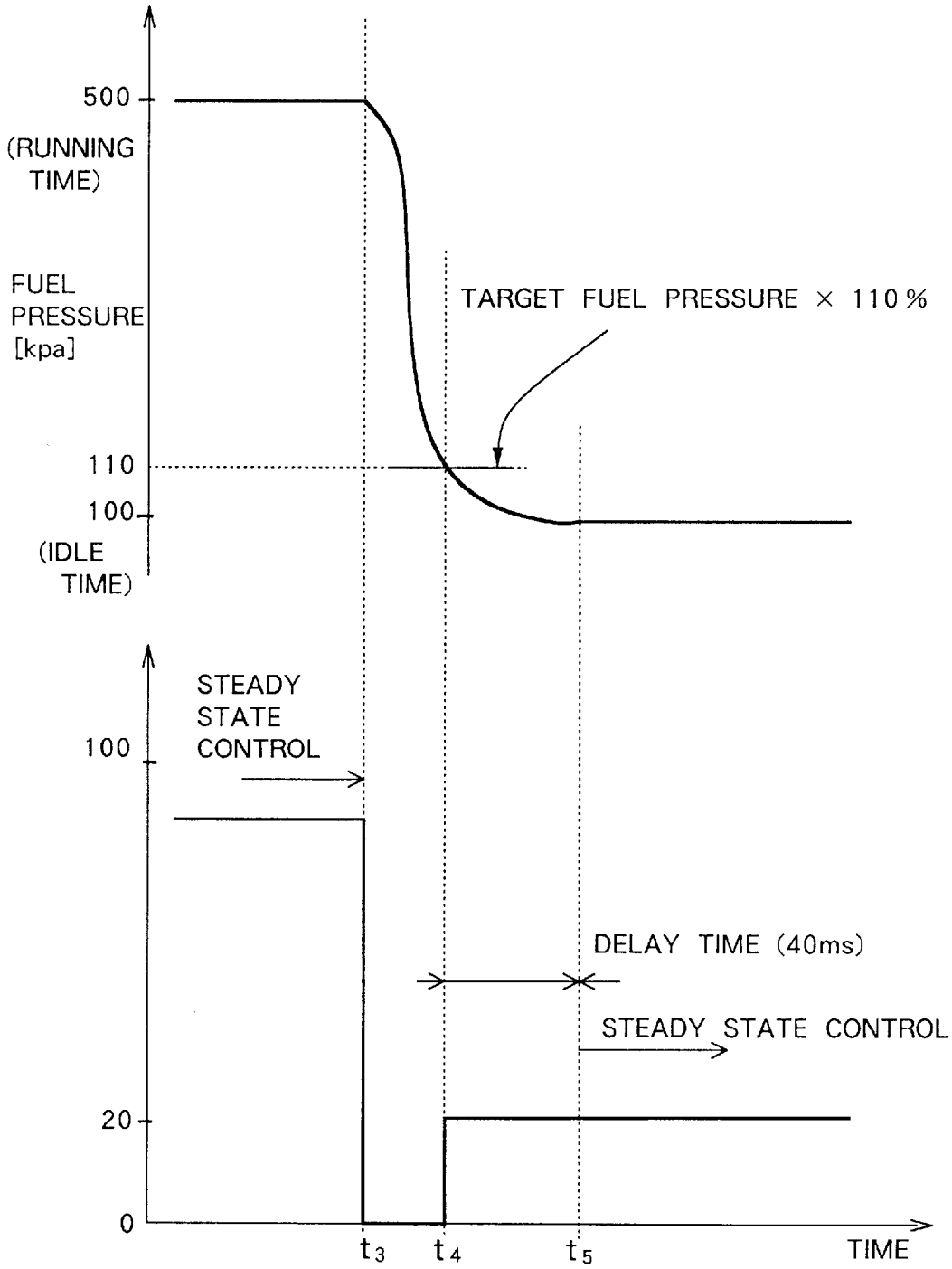
FIG. 5 is an explanatory diagram used for describing changes in set duty ratio and changes in fuel pressure that are made in response to an increase in target fuel pressure.

States of changes in control signal and fuel pressure are further explained by referring to FIGS. 4 and 5, diagrams showing changes in fuel pressure and duty ratio, by focusing on processing carried out at one cycle. FIG. 4 is a diagram showing changes in fuel pressure and duty ratio which occur in the case of an increase in target fuel pressure and FIG. 5 is a diagram showing changes in fuel pressure and duty ratio which occur in the case of a decrease in target fuel pressure.

First of all, changes in fuel pressure and duty ratio which occur in the case of an increase in target fuel pressure are explained by referring to FIG. 4. Here, a phenomenon occurring at a start, that is, a transition from an idle state to a steady running state, is given as an example. During a period prior to a time $t_0$, the operation of the engine is in a steady state wherein an intake pipe pressure measured by the intake pressure sensor 5 and a rotational speed of the engine detected by a crank angle sensor are supplied to the engine control unit 20. At the step S1, the target fuel pressure is set at 100 kPa, a value determined by the signals supplied to the engine control unit 20. Then, the outcome of the determination at the step S2 is No due to the fact that the operation of the engine is in a steady state, causing the flow of processing to go on to a step S10 at which steady state control is executed. That is, from the target fuel pressure set at the step S1 and a signal output by the fuel pressure sensor 3, the duty ratio is set at a typical value of approximately 20% at which the fuel pump 30 is driven. As a result, the pressure of the fuel is sustained at a constant value of 100 kPa.

Then, at the time $t_0$, the engine enters a state of acceleration, causing a new target fuel pressure of 500 kPa to be set at the step S1. In this case, the outcome of the determination at the step S2 is Yes, causing the flow of processing to proceed to the step S3 at which transient state control is executed. Since the change in target fuel pressure is an increase from 100 kPa to 500 kPa, the outcome of the determination at the step S3 is also Yes, causing the flow of processing to continue to the step S4. At the step S4, the duty ratio is set at 100% at which the fuel pump 30 is driven. As a result, the pressure of the fuel starts to increase abruptly. Then, the flow of processing goes on to the step S5 to determine whether or not the pressure of fuel supplied by the fuel pump 30 driven at the maximum fuel discharging power has reached 90% of the new target fuel pressure, that is, 90% of 500 kPa=(450 kPa). The pieces of processing carried out at the steps S4 and S5 are repeated till the outcome of the determination at the step S5 becomes Yes. Assume that at a time $t_1$, the pressure of the fuel reaches 450 kPa. Thus, during the period of time from $t_0$ to $t_1$, the fuel pump 30 is driven at a duty ratio of 100%. That is, since the fuel pump 30 is driven at the maximum fuel discharging power, the pressure of the fuel increases toward the target fuel pressure in a short period of time.

Then, at $t_1$, the point of time at which the pressure of the fuel reaches 450 kPa, the outcome of the determination at the step S5 becomes Yes, causing the flow of processing to go on to the step S8 to start execution of transition state control. At the step S8, from the target fuel pressure and the injection flow rate, the initial set value is found to be typically 80%. Then, the fuel pump 30 is driven at a fixed duty ratio of 80% and, at the same time, the delay timer is cleared. This driving operation continues till the contents of the delay timer reach a predetermined delay time of typically 40 msec as determined at the step S9. Thus, since the time $t_1$, the fuel pump 30 has been driven at a fixed duty ratio of 80% for 40 msec. As a result, the pressure of the fuel gradually increases to 500 kPa, preventing an overshoot from occurring in the change of the fuel pressure.

At $t_2$, a point of time 40 msec behind $t_1$, the outcome of the determination at the step S9 becomes Yes, causing the flow of processing to proceed to the step S10 at which the steady state control is restored. At the step S10, a new duty ratio is found from the target fuel pressure 500 kPa and a signal output by the fuel sensor 3. The fuel pump 30 is then driven at the new duty ratio. Thus, during a period following the time $t_2$, the steady state control is continued, keeping the pressure of the fuel at 500 kPa in a stable state as shown in FIG. 4 provided that there is no change in target fuel pressure.

Next, changes in fuel pressure and duty ratio which occur in the case of a decrease in target fuel pressure are explained by referring to FIG. 5. Here, a phenomenon of halting the fuel pump 30, that is, a transition from a steady running state to an idle state, is given as an example. During a period prior to a time $t_3$, the steady state control is executed at the target fuel pressure 500 kPa described above. That is, from the target fuel pressure set at the step S1 and a signal output by the fuel pressure sensor 3, the duty ratio is set at approximately 80% at which the fuel pump 30 is driven. As a result, the pressure of the fuel is sustained at a constant value of 100 kPa.

Then, at the time $t_3$, the engine enters a state of deceleration, causing a new target fuel pressure of 100 kPa to be set at the step S1. In this case, the outcome of the determination at the step S2 is Yes, causing the flow of processing to proceed to the step S3 at which transient state control is executed. Since the change in target fuel pressure is a decrease from 500 kPa to 100 kPa, the outcome of the determination at the step S3 is No, causing the flow of processing to continue to the step S6. At the step S6, the duty ratio is set at 0% in order to halt the fuel pump 30. As a result, the pressure of the fuel starts to decrease abruptly. Then, the flow of processing goes on to the step S7 to determine whether or not the pressure of fuel supplied by the fuel pump 30 has reached 110% of the new target fuel pressure, that is, 110% of 100 kPa (=110 kPa). The pieces of processing carried out at the steps S6 and S7 are repeated till the outcome of the determination at the step S7 becomes Yes. Assume that at a time $t_4$, the pressure of the fuel reaches 110 kPa. Thus, during the period of time from $t_3$ to $t_4$, the fuel pump 30 is driven at a duty ratio of 0% in order to halt the fuel pump 30 and to no longer supply fuel. That is, since fuel is consumed only in the fuel pipe, the pressure of the fuel decreases toward the new target fuel pressure in a short period of time.

Then, at $t_4$, the point of time at which the pressure of the fuel reaches 110 kPa, the outcome of the determination at the step S7 becomes Yes, causing the flow of processing to go on to the step S8 to start execution of transition state control. At the step S8, from the target fuel pressure and the injection flow rate, the initial set value is found to be typically 20%. Then, the fuel pump 30 is driven at a fixed duty ratio of 20% and, at the same time, the delay timer is cleared. This driving operation continues till the contents of the delay timer reach a predetermined delay time of typically 40 msec as determined at the step S9. Thus, since $t_4$, the fuel pump 30 has been driven at a fixed duty ratio of 20% for 40 msec. As a result, the pressure of the fuel gradually decreases to 100 kPa.

At $t_5$, a point of time 40 msec behind $t_4$, the outcome of the determination at the step S9 becomes Yes, causing the flow of processing to proceed to the step S10 at which the steady state control is restored. At the step S10, a new duty ratio is found from the target fuel pressure 100 kPa and a signal output by the fuel sensor 3. The fuel pump 30 is then driven at the new duty ratio. Thus, during a period following $t_5$, the steady state control is continued, keeping the pressure of the fuel at 100 kPa in a stable state as shown in FIG. 4 provided that there is no change in target fuel pressure.

As described in detail above, according to the fuel pump control apparatus implemented by the present embodiment, a duty ratio at which the fuel pump 30 is driven is found by adopting different techniques for a case with a change in target fuel pressure or a change in operating state of the engine 2 and a case with no change in target fuel pressure or no change in operating state of the engine 2. Thus, fuel can be supplied to the engine 2 at a fuel pressure or at a fuel flow rate requested by the engine 2 with a high degree of accuracy. When the target fuel pressure is changed, the duty ratio of the driving signal is set at 100% or 0% to execute transient state control on the fuel pump 30 so that the pressure of the fuel can be changed in a short period of time. As a result, the pressure of the fuel can be changed to the new target in a short period of time. In addition, the steady state control is restored from the transient state control through transition state control, preventing the pressure of the fuel from becoming unstable.

As described above, by merely controlling the operation to drive the fuel pump 30, the pressure of the fuel can be changed with a high degree of accuracy. Thus, components for changing the pressure of the fuel are not required. As a result, the fuel supply system can be designed into a return-less configuration, allowing its cost and its size to be reduced. In addition, since the fuel supply system does not include components such as valves and pressure regulators, it is sufficient to merely supply fuel at a flow rate requested by the engine 2, allowing the fuel pumping capacity and the electric power consumption of the fuel pump 30 to be reduced.

It should be noted that the description of the first embodiment given above is not intended to be construed in a limiting sense. That is, the scope of the present invention is not limited to the present embodiment. A variety of improvements and modifications can of course be made to the present embodiment as long as the improvements and the modifications are within a range not departing from the essentials thereof. For example, in the present embodiment described above, an operation to drive a fuel pump is controlled by varying the duty ratio of a signal for driving the fuel pump. It should be noted that the operation to drive the fuel pump can also be controlled by varying a voltage applied to the fuel pump by means of a DC-DC converter. In addition, the rotational speed of the engine can also be found from ignition signals applied to ignition plugs instead of using a crank angle sensor. It should be noted that predetermined numerical values set for a target fuel pressure such as typical fuel pressures of 90% and 110% of the target and a typical delay time of 40 msec are no more than examples.

Second Embodiment

Figure 6:
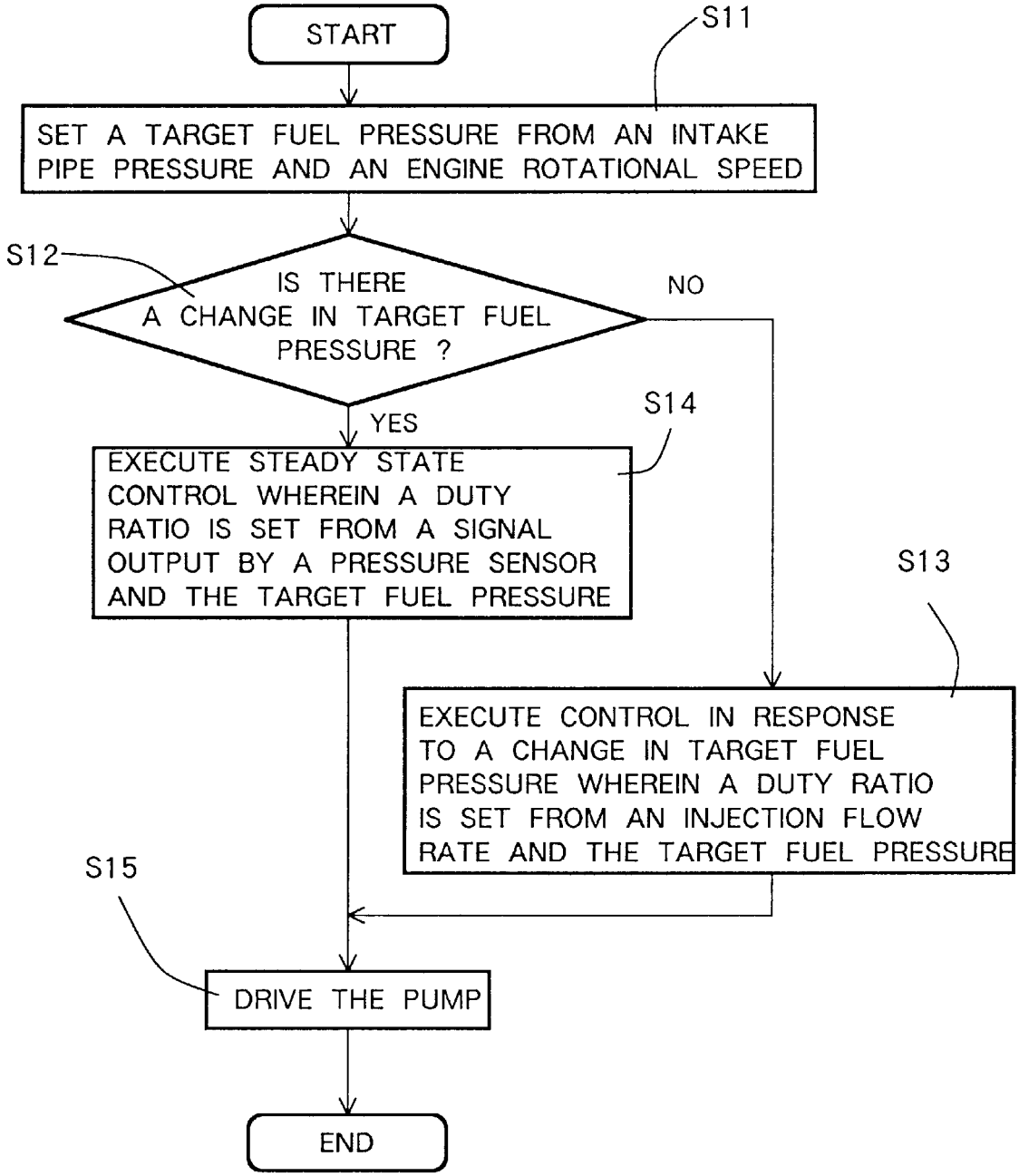
FIG. 6 is a flowchart representing a routine of control processing carried out by a second embodiment implementing a fuel pump control apparatus provided by the present invention.

Since the only difference between a second embodiment and the first embodiment is the control method, the explanation of the former is omitted except for the control method which is described by referring to FIG. 6, a flowchart representing a processing routine of the control executed by the second embodiment.

Step S11

As shown in the figure, the flowchart begins with a step S11 at which a target fuel pressure is calculated from the intake pipe pressure and the rotational speed of the engine. That is, the step S11 corresponds to processing carried out by a target fuel pressure computing means. The calculation of the target fuel pressure at the step S11 is the same as that carried out at the step S1 in the first embodiment.

Step S12

The flow of processing then goes on to a step S12 to determine whether or not there is a difference in target fuel pressure between the previous and current cycles, that is, a determination whether or not the operating state of the engine 2 is a steady or transient state. The step S12 corresponds to processing carried out by a change detecting means. If the outcome of the determination indicates that there is a difference in target fuel pressure between the previous and current cycles (S12: Yes), the flow of processing proceeds to a step S14. If the outcome of the determination indicates that there is no difference in target fuel pressure between the previous and current cycles (S12: No), on the other hand, the flow of processing proceeds to a step S13. At the step S13 or S14, the duty ratio of a voltage for driving the fuel pump 30 is computed.

Step S13

At the step S13, the pressure of the fuel in the fuel rail 34*a* is all but constant due to the fact that the operation of the engine 2 is in a steady state. Thus, since the signal output by the fuel pressure sensor 3 is stable, the difference between the fuel pressure measured by the fuel pressure sensor 3 and the target fuel pressure can be found with a high degree of accuracy. The operation to drive the fuel pump 30 can be controlled so as to correct this difference. Thus, at the step S13, a duty ratio of a voltage for driving the fuel pump 30 can be computed from the fuel pressure measured by the fuel pressure sensor 3 and the target fuel pressure found at the step S11 in a steady state control to drive the fuel pump 30. As a result, the pressure of the fuel in the fuel rail 34*a* can be made stable.

Step S14

At the step S14, on the other hand, the pressure of the fuel in the fuel rail 34*a* is changing due to the fact that the operation of the engine 2 is in a transient state. Thus, the signal output by the fuel pressure sensor 3 is also changing. A big change of the signal output by the fuel pressure sensor 3 is observed as an overshoot in some cases. In such a state, an accurate duty ratio of the voltage for driving the fuel pump 30 can not thus be found from the fuel pressure measured by the fuel pressure sensor 3 and the target fuel pressure found at the step S11. In this case, it is therefore difficult to control the pressure of the fuel in the fuel rail 34*a* by controlling the operation to drive the fuel pump 30. For this reason, a duty ratio of the voltage for driving the fuel pump 30 is found from an injection flow rate at the fuel injection nozzle 6 and the target fuel pressure found at the step S11. Thus, transient state control based on an injection flow rate at the fuel injection nozzle 6 is executed on the fuel pump 30. As a result, the pressure of the fuel in the fuel rail 34*a* can be changed to the target fuel pressure and made stable in a short period of time. The calculation of a duty ratio at the step S14 is the same as that carried out at the step S8 for the first embodiment.

Step S15

The flow of processing then goes on from either the step S13 or S14 to a step S15 at which the fuel pump 30 is driven by turning the voltage of the power supply applied to the fuel pump 30 on and off at a duty ratio found at the step S13 or S14. The step S15 thus corresponds to processing carried out by a pump driving means. The pieces of processing of the steps S11 to S15 are repeated at intervals of several milliseconds in order to execute the control of an operation to drive the fuel pump 30 with a high degree of accuracy.

As described in detail above, according to the fuel pump control apparatus implemented by the present embodiment, a duty ratio of a voltage for driving the fuel pump 30 is found by adopting different techniques for a case with a change in operating state of the engine 2 or a transient state case and a case with no change in operating state of the engine 2 or a steady state case. When the operation of the engine 2 is in a steady state, the signal output by the fuel pressure sensor 3 is stables. A duty ratio of a voltage for driving the fuel pump 30 can thus be computed from the fuel pressure measured by the fuel pressure sensor 3 and the target fuel pressure. As a result, in a steady state, stable steady state control can be executed. When the operation of the engine 2 is in a transient state, on the other hand, a duty ratio of the voltage for driving the fuel pump 30 is found from the target fuel pressure and an injection flow rate at the fuel injection nozzle 6 in place of the signal output by the fuel sensor 3 because the pressure of the fuel also varies in execution of the transient state control. As a result, the pressure of the fuel in the fuel rail 34*a* can be changed to the target fuel pressure in a short period of time with a high degree of accuracy even if the pressure of the fuel changes substantially in the steady state.

As described above, in the fuel pump control apparatus implemented by the present embodiment, it is needless to say that the pressure of the fuel supplied to the engine 2 can be brought to a target fuel pressure in a stable manner without returned fuel of course in the case of a small change in engine operating state even though this statement also holds true of a big change in engine operating state. In addition, when the target fuel pressure is changed due to a change in engine operating state occurring in a transient state such as a start time, an acceleration or a run on an ascending road, the pressure of the fuel can be controlled to keep up with the new target fuel pressure in a short period of time. As a result, it is possible to implement a fuel supply system for supplying fuel to fuel injection nozzles at a lowest possible flow rate required in the operation of the engine without the need to install a pressure regulator. In addition, since the fuel pump is driven to output only fuel of a smallest possible amount required for the fuel supply to the engine including an amount to keep up with a change in fuel pressure, the electric power consumption can be reduced while the little noise characteristic can be enhanced.

It should be noted that the description of the second embodiment is not intended to be construed in a limiting sense. That is, the scope of the present invention is not limited to the second embodiment. A variety of improvements and modifications can of course be made to the present embodiment as long as the improvements and the modifications are within a range not departing from the essentials thereof. For example, in the present embodiment described above, an operation to drive a fuel pump is controlled by varying the duty ratio of a voltage applied to the fuel pump. It should be noted that the operation to drive the fuel pump can also be controlled by varying the voltage applied to the fuel pump by means of a DC-DC converter. In addition, the target fuel pressure can also be found by using a predetermined routine program. Furthermore, the rotational speed of the engine can also be found from ignition signals applied to ignition plugs instead of using a crank angle sensor.

What is claimed is:

1. A fuel pump control apparatus for controlling a fuel pump supplying fuel to a fuel injection nozzle of an engine, said fuel pump control apparatus comprising:

target fuel pressure computing means for computing a target fuel pressure on the basis of an operating state of said engine;

change detecting means for detecting whether or not said target fuel pressure has changed;

steady state control means which is used for determining a control quantity of said fuel pump on the basis of a pressure of said fuel supplied to said fuel injection nozzle and said target fuel pressure when said target fuel pressure is found unchanged;

transient state control means which is used for determining said control quantity of said fuel pump by adopting a method different from that of said steady state control means when said target fuel pressure is found changed; and wherein said transient state control means sets said control quantity at a maximum or minimum value.

2. A fuel pump control apparatus according to claim 1 further provided with direction detecting means for recognizing a direction of a change in said target fuel pressure.

3. A fuel pump control apparatus according to claim 2 wherein said transient state control means sets said control quantity at said maximum value when said target fuel pressure increases.

4. A fuel pump control apparatus according to claim 2 wherein said transient state control means sets said control quantity at said minimum value when said target fuel pressure decreases.

5. A fuel pump control apparatus according to claim 3 wherein said transient state control means sets said control quantity at said minimum value when said target fuel pressure decreases.

6. A fuel pump control apparatus according to claim 1 wherein said transient state control means executes control till the absolute value of a difference between the pressure of said fuel supplied to said fuel injection nozzle and said target fuel pressure becomes smaller than a predetermined value.

7. A fuel pump control apparatus according to claim 6 wherein said predetermined value is ±10% of said target fuel pressure.

8. A fuel pump control apparatus according to claim 6 further provided with transition state control means which is used for determining said control quantity of said fuel pump by adopting a method different from those of said steady state control means and said transient state control means after the absolute value of a difference between the pressure of said fuel supplied to said fuel injection nozzle and said target fuel pressure has become smaller than said predetermined value.

9. A fuel pump control apparatus according to claim 8 wherein said transition state control means determines said control quantity of said fuel pump on the basis of a flow rate of said fuel at said fuel injection nozzle and said target fuel pressure.

10. A fuel pump control apparatus according to claim 9 wherein, for a large value of said target fuel pressure, said transition state control means determines a value of said control quantity larger than that for a small value of said target fuel pressure.

11. A fuel pump control apparatus according to claim 9 wherein, for a large value of said flow rate of said fuel at said fuel injection nozzle, said transition state control means determines a value of said control quantity larger than that for a small value of said flow rate of said fuel at said fuel injection nozzle.

12. A fuel pump control apparatus according to claim 10 wherein, for a large value of said flow rate of said fuel at said fuel injection nozzle, said transition state control means determines a value of said control quantity larger than that for a small value of said flow rate of said fuel at said fuel injection nozzle.

13. A fuel pump control apparatus according to claim 8 wherein control by said transition state control means is executed for a period of time it takes to stabilize control of the pressure of said fuel.

14. A fuel pump control apparatus according to claim 1 wherein said fuel pump is controlled by driving based on a duty ratio.

* * * * *